US005916016A

United States Patent [19]

Bothra

[11] Patent Number: 5,916,016

[45] Date of Patent: Jun. 29, 1999

[54] METHODS AND APPARATUS FOR POLISHING WAFERS

[75] Inventor: Subhas Bothra, San Jose, Calif.

[73] Assignee: VLSI Technology, Inc., San Jose, Calif.

[21] Appl. No.: 08/956,836

[22] Filed: Oct. 23, 1997

[51] Int. Cl.[6] ..... B24B 5/00

[52] U.S. Cl. ..... 451/398; 451/289; 451/388; 451/5; 451/41

[58] Field of Search ..... 451/388, 398, 451/289, 288, 287, 5, 24, 41

[56] References Cited

U.S. PATENT DOCUMENTS

| | | | |
|---|---|---|---|
| 5,653,622 | 8/1997 | Drill et al. | 451/5 |
| 5,762,539 | 6/1998 | Nakashiba et al. | 451/41 |
| 5,791,978 | 8/1998 | Cesna et al. | 451/388 |

OTHER PUBLICATIONS

J. Hernandez, P. Wrschka, H. Sun, Y. Hsu, T. Kuan and G. Oehrlein, University of Albany, New York, NY; D. Hansen and J. King, Cybeq Nano Tech., Menlo Park, CA; and M. Fury of Rodel, Newark, DE. "Mechanistic Studies of Chemical–Mechanical Polishing of Al Films", Feb. 13–14, 1997, CMP–MIC Conf., '97 ISMIC, pp. 125–128.

*Primary Examiner*—David A. Scherbel
*Assistant Examiner*—Dung Van Nguyen
*Attorney, Agent, or Firm*—Martine Penilla & Kim, LLP

[57] ABSTRACT

Disclosed is a chemical mechanical polishing system. The system includes a mechanical arm and a carrier body that is configured to be coupled to the mechanical arm. The carrier body has a recessed portion for retaining a semiconductor wafer. The recessed portion has a carrier film that is in direct contact with a back side of the semiconductor wafer. The system further includes a plurality of pressure rings that are defined in the carrier body, such that the plurality of pressure rings are in direct contact with the carrier film. Each of the plurality of pressure rings are used to apply a selected pressure to the carrier film, such that the carrier film produces a back pressure against the back side of the semiconductor wafer. The back pressure is configured to be consistent with the selected pressure that is applied to each of the plurality of pressure rings. Whereby the selected pressure that is applied to each of the plurality of pressure rings controls a polishing rate in a plurality of concentric areas of the semiconductor wafer that correspond to the plurality of pressure rings.

25 Claims, 10 Drawing Sheets

280

| SET Recipe | ZONE 1 (216) | ZONE 2 (214) | ZONE 3 (212) |
|---|---|---|---|
| Recipe 1 | 6 (psi) | 7 (psi) | 8 (psi) |
| Recipe 2 | 8 (psi) | 7 (psi) | 6 (psi) |
| Recipe N | 6 (psi) | 8 (psi) | 6 (psi) |

FIG. 2D

| SET Recipe | ZONE 1 (216a) | ZONE 2 (216b) | ZONE 3 (214a) | ZONE 4 (214b) | ZONE 5 (212a) | ZONE 6 (212b) |
|---|---|---|---|---|---|---|
| Recipe 1 | 6 (psi) | 6.5 (psi) | 7 (psi) | 7 (psi) | 7.5 (psi) | 8 (psi) |
| Recipe 2 | 8 (psi) | 7.5 (psi) | 7 (psi) | 7 (psi) | 6.5 (psi) | 6 (psi) |
| Recipe N | 6 (psi) | 7 (psi) | 8 (psi) | 8 (psi) | 7 (psi) | 6 (psi) |

METHODS AND APPARATUS FOR POLISHING WAFERS

BACKGROUND OF THE INVENTION

1. Field of the Invention

The present invention relates generally to integrated circuits and, more particularly, to methods and apparatus for polishing wafers in chemical mechanical polishing systems.

2. Description of the Related Art

In the fabrication of semiconductor devices, wafers are typically processed through a number of well known process operations. Some of the conventional process operations include oxide deposition operations, metallization sputtering operations, photolithography operations, etching operations and various types of planarization operations. Because a semiconductor device is fabricated as a multi-level device that may have a number of metallization levels (and oxide levels in between), the need to planarize some of the layers before a next layer is applied becomes very apparent when the topographical variations start to increase. Consequently, if the topographical variations become too pronounced, the fabrication of additional levels may become restrictive, in that the topographical variations can limit the degree of precision needed to fabricate dimension sensitive integrated circuit devices.

One common planarization technique is referred to as chemical mechanical polishing (CMP). FIG. 1A shows a simplified drawing of a CMP apparatus 100 that functions as a polishing system is used to planarize various material layers that may be applied to a wafer 102 during a fabrication process. As is well known, the CMP apparatus 100 includes a robot arm 108 that has a wafer carrier 106 for handling the wafer 102 during a polishing operation. As shown, the actual planarization of the wafer 102 occurs when the robot arm 108 that functions as a mechanical arm for lowering the wafer carrier 106 down to a polishing pad 104. To complete a planarization operation, the polishing pad 104 is usually conditioned (i.e., to maintain the polishing pad's texture) before each new planarization operation is performed and a polishing slurry having a specific PH level is applied to the surface of the polishing pad 104. Once the polishing pad 104 is rotating at a given rpm, the wafer carrier 106 is lowered and placed in contact with the polishing pad 104. Once contact is made with the polishing pad, the CMP apparatus 100 will supply a back pressure (BP) to a back surface 103 of the wafer 102.

FIG. 1B shows a more detailed view of the wafer carrier 106 of FIG. 1A. This detailed view shows that the back pressure (BP) is conventionally applied to the center region of the wafer 102. As a result, when the wafer 102 is compressed against the polishing pad 104 during a planarization operation, the center region of the wafer 102 will polish at a faster rate than the outer regions 102*a*. In addition, it has been observed that prior art wafer carriers 106 have a lip 105 that prevents the back pressure (BP) from being applied to the edges of the back surface 103 of wafer 102. As a result, even though the applied back pressure (BP) is constant in a cavity 107, the pressure (P) applied to the back surface of the wafer is not, and therefore, non-uniform polishing rates over the surface of the wafer 102 have become increasingly problematic.

As mentioned above, the non-uniform polishing rates are most evident in the topographical variations that remain at the edge of the wafer 102. This topographical variation is a particular problem in the fabrication of shallow trench isolation (STI) where this is about 4 mm edge effect with remaining oxide due to a polishing pad re-bound effect at the edge of the wafer 102. The down side to the topographical variations is that many of the dies at the edge of the wafer 102 will become damaged, and therefore, will be unusable. In fact, for larger size wafers, the number of damaged dies on a particular wafer 102 will increase, thereby driving up the fabrication costs and reducing throughput.

In view of the foregoing, what is needed is a chemical mechanical polishing system that is capable of programmably controlling the back pressure (BP) that is applied to the back side of a wafer during a chemical mechanical polishing operation.

SUMMARY OF THE INVENTION

Broadly speaking, the present invention fills these needs by providing methods and apparatus for programmably controlling the back pressure that is applied through a wafer carrier to the back side of a wafer during a chemical mechanical polishing operation. It should be appreciated that the present invention can be implemented in numerous ways, including as a process, an apparatus, a system, a device, a computer readable medium or a method. Several inventive embodiments of the present invention are described below.

In one embodiment, a wafer carrier for use in polishing a semiconductor wafer is disclosed. The wafer carrier includes a carrier body that has a recessed portion for retaining the semiconductor wafer. The recessed portion has a carrier film that is in direct contact with a back side of the semiconductor wafer. The wafer carrier further includes a plurality of pressure rings that are defined in the carrier body, such that the plurality of pressure rings are in direct contact with the carrier film. Each of the plurality of pressure rings are configured to be pre-set to apply a selected pressure to the carrier film. Wherein the carrier film produces a back pressure against the back side of the semiconductor wafer that is consistent with the selected pressure associated with each of the plurality of pressure rings.

In another embodiment, a method for making a wafer carrier for use in a semiconductor wafer polishing system is disclosed. The method includes providing a carrier body having a recessed end for receiving a wafer. Defining a plurality of circular cavities in a region of the carrier body that is behind the wafer, and each of the plurality of circular cavities have an adjacent surface that lies behind the wafer when the wafer is in the recessed end of the carrier body. The method further includes providing a selected pressure to each of the plurality of circular cavities to cause a predetermined back pressure on the adjacent surface that lies behind the wafer.

In yet another embodiment, a chemical mechanical polishing system is disclosed. The system includes a mechanical arm, and a carrier body that is configured to be coupled to the mechanical arm. The carrier body has a recessed portion for retaining a semiconductor wafer. The recessed portion has a carrier film that is in direct contact with a back side of the semiconductor wafer. The system further includes a plurality of pressure rings that are defined in the carrier body, such that the plurality of pressure rings are in direct contact with the carrier film. Each of the plurality of pressure rings are used to apply a selected pressure to the carrier film, such that the carrier film produces a back pressure against the back side of the semiconductor wafer. The back pressure is configured to be consistent with the selected pressure that is applied to each of the plurality of pressure rings. Whereby the selected pressure that is applied to each of the plurality of pressure rings controls a polishing rate in a plurality of concentric areas of the semiconductor wafer that correspond to the plurality of pressure rings.

Advantageously, it should be apparent to those skilled in the art of semiconductor polishing that the ability to variably program different back pressures during a polishing operation allows precision control of polishing rates over the surface of a wafer. Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings. Therefore, like reference numerals designate like structural elements.

FIG. 2D is a pressure table illustrating pressure selections for the various pressure zones in accordance with one embodiment of the present invention.

DETAILED DESCRIPTION OF THE PREFERRED EMBODIMENTS

An invention for methods and apparatus for programmably controlling and applying a back pressure through a wafer carrier to the back side of a wafer during a chemical mechanical polishing operation is disclosed. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 2A:
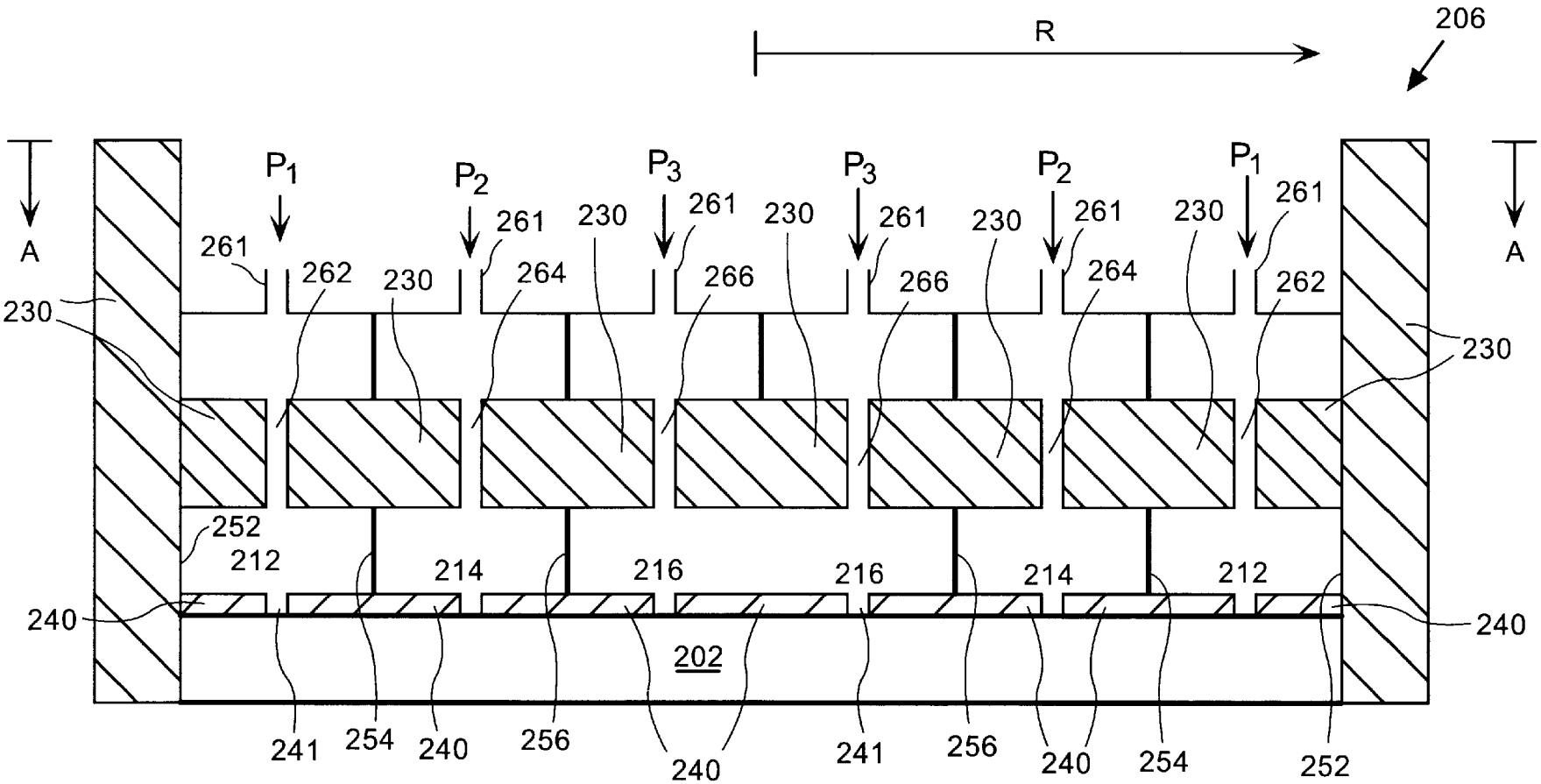
FIG. 2A is a cross-sectional view of a wafer carrier in accordance with one embodiment of the present invention.

FIG. 2A is a cross-sectional view of a wafer carrier 206 (i.e., a carrier body), in accordance with one embodiment of the present invention. As shown, the wafer carrier 206 is well suited to receive a wafer 202 in a recessed bottom section that defines a recessed portion of the wafer carrier 206. In this manner, the back side of wafer 202 is positioned in direct contact with a carrier film 240 and the processed side of the wafer 202 is freely exposed, so that a robot arm (not shown) of a CMP apparatus can lower the wafer carrier 206 against a polishing pad that is spinning in a direction that is opposite to that of the spinning wafer carrier 206.

In one embodiment, the wafer carrier 206 is shown having a plurality of zones 212, 214, and 216 (e.g., a plurality of circular cavities), which are divided by pressure separation ridges 252, 254, and 256. The zones are used to programmably apply different back pressures (BP) to different concentric ring regions that define a plurality of pressure cavity rings behind the wafer 202. By way of example, a pressure ($P_1$) may be applied to a concentric ring that is defined between pressure separation ridges 252 and 254, such that a higher back side pressure is applied to the outer edges of the wafer 202 during a chemical mechanical polishing (CMP) operation.

Figure 1A:
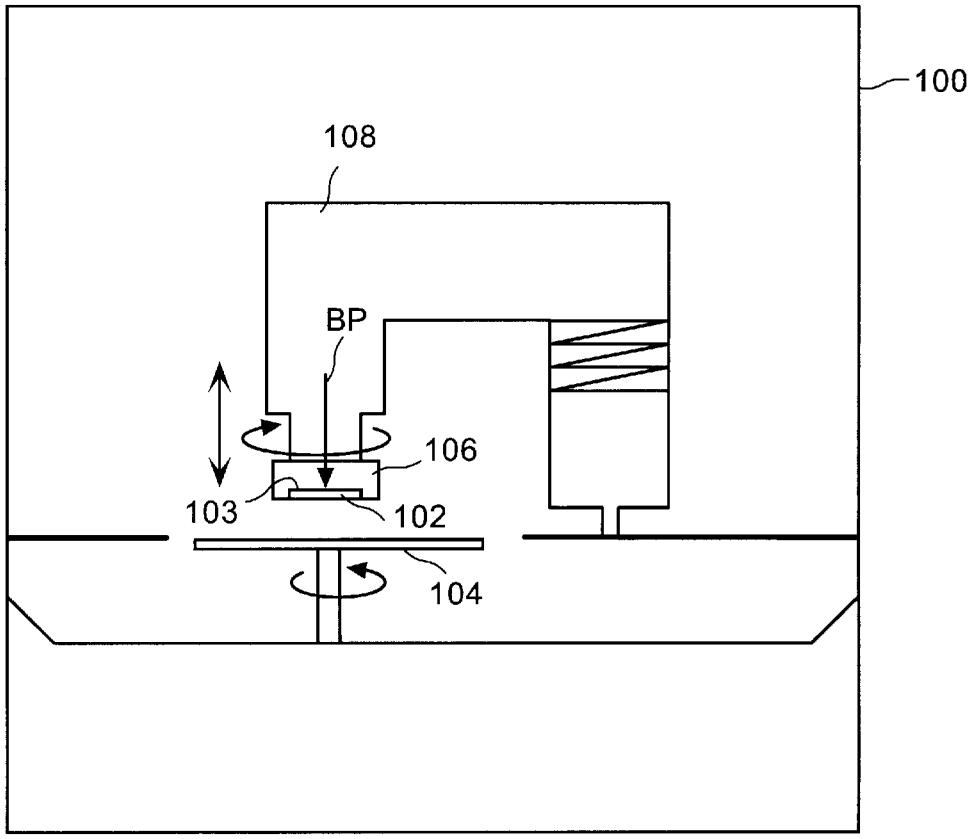
FIG.1A (prior art)
FIGS. 1A and 1B illustrate a chemical mechanical polishing system and wafer carrier having a conventional back pressure application system.
Figure 1B:
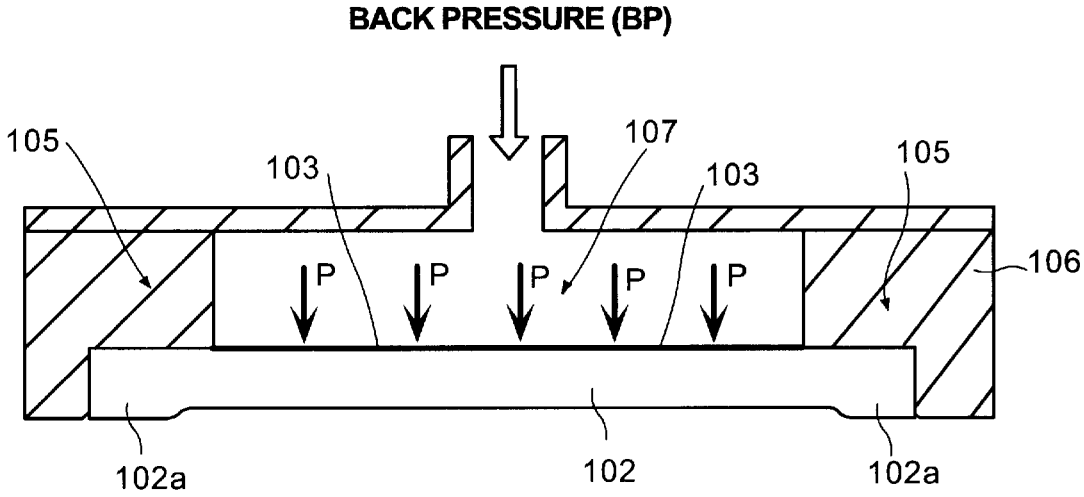
FIG.1B (prior art)

When a slightly higher pressure is applied to the back side of the outer edge, a slightly lower pressure ($P_3$) is fed into zone 216 near the center region back side of the wafer 202. By applying a progressively lower pressure near the center of the back side of wafer 202 and progressively increasing the amount of pressure out to the outer radius "R" of the wafer 202, the above-described edge non-uniformities 102*a* of FIG. 1B are substantially eliminated.

In one embodiment, the main body of the wafer carrier 206 is preferably made of any suitable material which is rigid enough to be used in a chemical mechanical polishing apparatus. Preferably, the material 230 is selected from a stainless steel material or other suitable alloys. The different pressures are applied to the various zones through inlets 261, which lead down to conduits 262, 264, and 266 that are used to deliver the various selected pressures down to zones 212, 214, and 216.

Once the desired pressure has been provided to the different zones that make up a pressure ring behind the wafer 202, a user may modify the various pressures depending on the type of non-uniformity variation being experienced. By way of example, if the rate of polishing is much faster at the center of the wafer 202, the user may want to increase the pressure being applied in zones 214 and 212 to increase the polishing rate at the outer edges in response to the added pressure applied to the back side of wafer 202.

In this embodiment, the carrier film 240 will preferably have a number of pin holes 241 that define a passage down to the back side surface of the wafer 202. The pin holes 241 are particularly useful when the wafer carrier 206 is directed by a robot arm to pick up a new wafer 202 through the use of a vacuum unit (not shown) implemented by the chemical mechanical polishing system. That is, before the polishing operation is performed, the wafer 202 is secured to the wafer carrier 206 by controllably applying an equal vacuum pressure to each of the zones 212, 214, and 216. The vacuum pressure therefore ensures that the wafer 202 remains in the recessed region of the wafer carrier 206.

Once the wafer and the carrier are lowered down to the polishing pad to commence a planarization operation, the programmable back side pressures are applied to the selected concentric rings defined by zones 212, 214, and 216. When the desired pressures are being applied to the various zones 212, 214, and 216, the pressure is simultaneously applied to the carrier film 240, which acts as a membrane that pushes against the back side surface of the wafer 202, depending on the particular pressure being applied to the concentric region of the wafer 202.

Figure 2B:
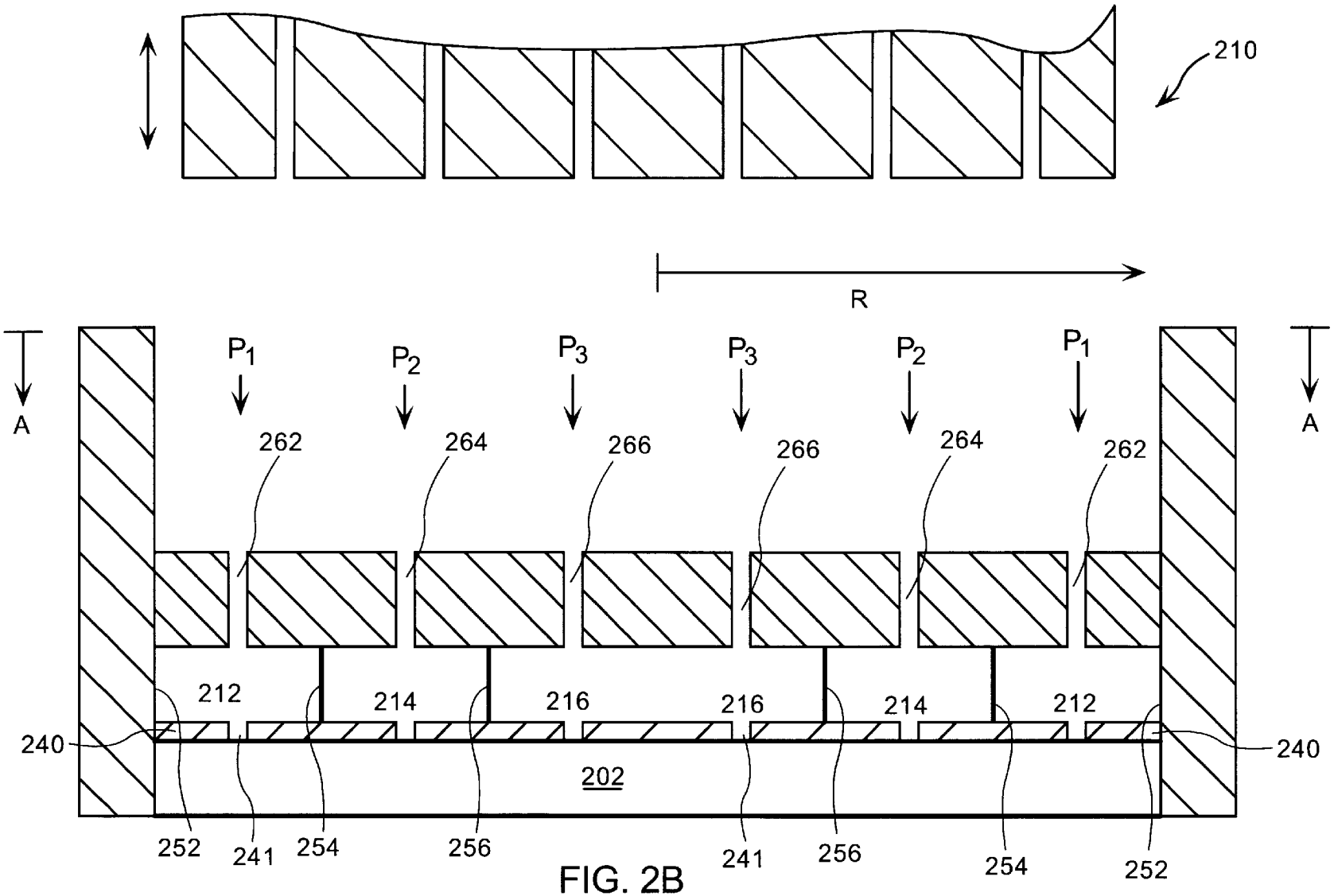
FIG. 2B shows the wafer carrier in accordance with an alternative embodiment of present invention.

FIG. 2B shows the wafer carrier 206 in accordance with an alternative embodiment of present invention. In this embodiment, the pressures applied to the conduits 262, 264, and 266 are directly coupled to complimentary conduit lines that are integrated in the robot arm 210, which is configured to receive the wafer carrier 206 via a connector.

Figure 2C:
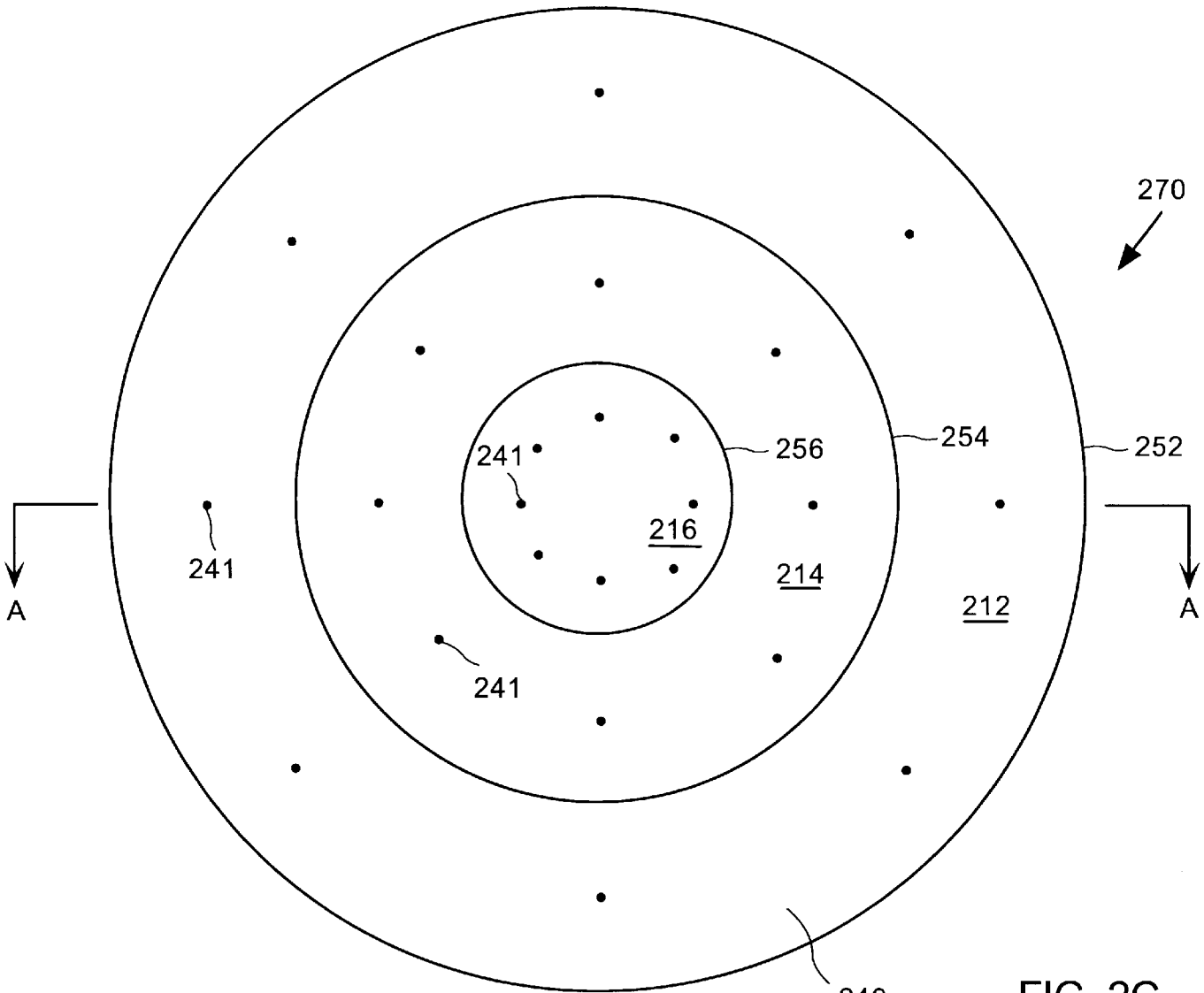
FIG. 2C is a top view of the various zones that are separated by the pressure separation ridges in accordance with one embodiment of the present invention.

FIG. 2C is a top view of the various zones 212, 214, and 216 which are separated by the pressure separation ridges 256, 254, and 252 in accordance with one embodiment of the present invention. Therefore, from this top view, the top surface of the carrier film 240 which lies over the wafer 202, is shown to better illustrate the concentric pressure rings that may be programmably set with varying pressures. As mentioned above, by applying a higher pressure to a particular zone that lies over the wafer 202, it is possible to increase the rate of polishing over those regions of the wafer 202.

Accordingly, if conventional chemical mechanical polishing (CMP) wafer carriers are found to leave a buildup near the edges of a wafer 202 (as shown in FIG. 1B), higher pressure should be applied to the outer concentric ring that lies in the back side of wafer 202. On the other hand, if it becomes apparent that the center of a particular wafer is polishing at a slower rate than the outer edges, then it may be desirable to increase the pressure at the center concentric rings, defined by pressure separation ridges 256 and 254. When this is done, slightly lower pressures are applied to the outer ring defined by zone 212, to enable a decreased rate of polishing for the edges of the wafer 202.

FIG. 2D is a pressure table 280 illustrating pressure selections for the various zones in accordance with one embodiment of the present invention. As mentioned above, if it is determined that the rate of polishing is slower at the outer edges of a particular wafer, it may be desirable to increase the pressure at that outer zone 212 and progressively decrease the pressure down to zone 216. For an exemplary 6-inch wafer, it may be desirable to apply about 8 pounds per square inch (psi) in zone 212, about 7 psi in zone 214, and about 6 psi in zone 216 in accordance with a recipe 1.

In another example, recipe 2 may be desired when the rate of polishing is greater at the outer edges than at the center of the wafer 202. If this is the case, about 8 psi is applied in zone 1, about 7 psi is applied in zone 2, and about 6 psi is applied in zone 3. With this pressure selection, the polishing rates will be increased at the center of the wafer to compensate the slower rate which was detected in a polishing operation before the varying back side pressure was applied.

As a further example, if any other types of polishing rate non-uniformities are detected, the inventive programmable pressure application may be adjusted to apply an increased pressure in those regions in which the polishing rate is lagging. As a result, the selective increased pressure at the back side of the wafer will assist in accomplishing a uniform polishing rate throughout the whole surface of a particular wafer, irrespective of the size of the wafer.

Figure 3A:
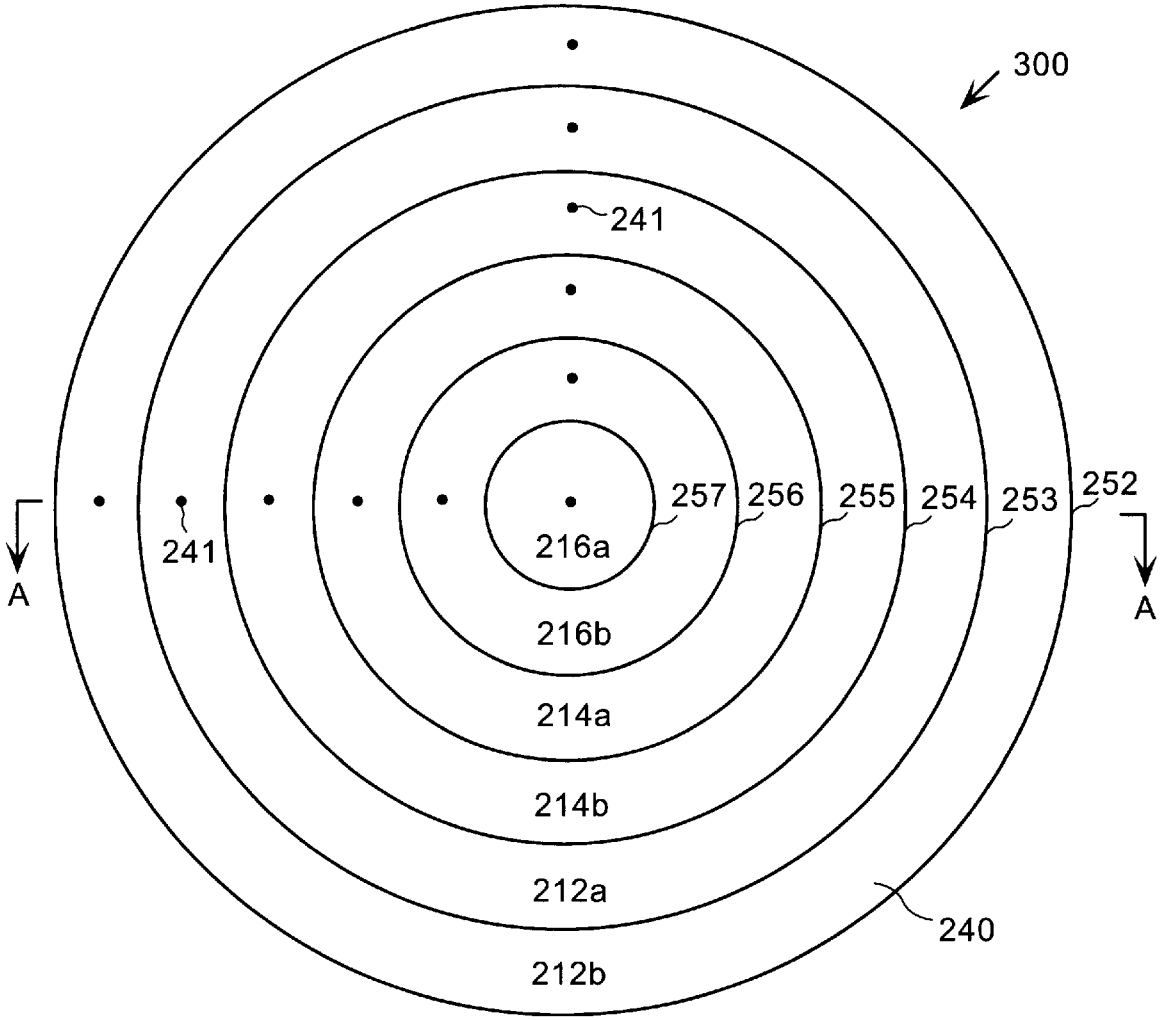
FIG. 3A shows a top view of the carrier film having additional pressure separation ridges in order to increase the number of concentric pressure rings around a particular wafer in accordance with one embodiment of the present invention.

FIG. 3A shows a top view of the carrier film 240 having additional pressure separation ridges in order to increase the number of concentric pressure rings around a particular wafer 202 in accordance with one embodiment of the present invention. As shown, zone 212 is now divided into a zone 212*a* and a zone 212*b* which is separated by a pressure separation ridge 253. Zone 214 is divided into a zone 214*a* and a zone 214*b* which is separated by a pressure separation ridge 255. Finally, zone 216 is divided into a zone 216*a* and a zone 216*b* by a pressure separation ridge 257.

It is important to note therefore, that the number of zones in which the back side pressure may be divided is flexible, depending on the particular needs of a fabrication process. By way of example, if only a very slight lag in polishing rate is being experienced at the very outer edge of a wafer 202, only an increased back side pressure is applied to zone 212*b,* to thereby increase the polishing rate of the wafer 202 around the outermost concentric ring in zone 212*b*.

Figures 3B, 3C:
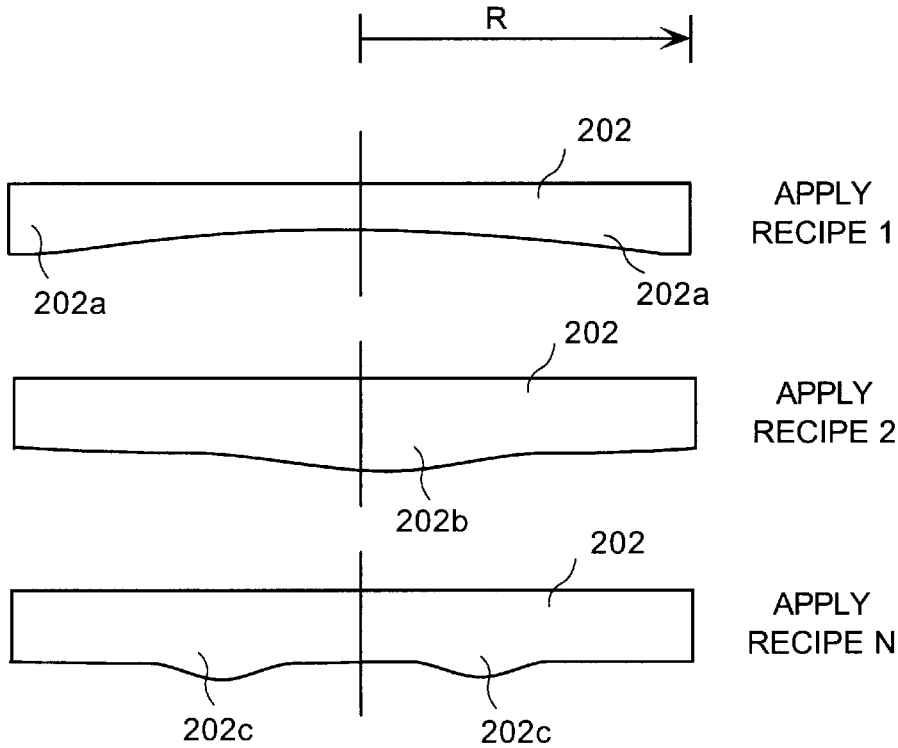
FIG. 3B is a table illustrating the preferred pressures applied to the various zones for different recipes in accordance with one embodiment of the present invention.
FIG. 3C is a pictorial representation of zones in which more directed pressure will assist in evenly planarizing a wafer with different recipes in accordance with one embodiment of the present invention.

FIG. 3B is a table illustrating the preferred pressures applied to the various zones for different recipes in accordance with one embodiment of the present invention. In recipe 1, a higher pressure is preferably applied to the outer zone 6, and then gradually decreased to apply a pressure of about 6 psi to zone 1. As shown in FIG. 3C, a higher pressure is preferably progressively applied from zone 1 up to zone 6 to increase the rate of polishing at the outer edges 202*a* of wafer 202. In this manner, the rate of polishing at the outer edges of wafer 202 will be equal to the rate of polishing at the center of wafer 202, thereby substantially eliminating any non-uniformities.

Table A shows that the ranges for recipe 1 may vary, depending on the type of materials being polished with the polishing system in accordance with the present invention.

TABLE A

| | Zone 1 | Zone 2 | Zone 3 | Zone 4 | Zone 5 | Zone 6 |
|---|---|---|---|---|---|---|
| Most Preferred | 6 psi | 6.5 psi | 7 psi | 7 psi | 7.5 psi | 8 psi |
| More Preferred | 4–8 psi | 4–8 psi | 5–9 psi | 5–9 psi | 5–9 psi | 6–10 psi |
| Preferred | 2–12 psi | 2–12 psi | 2–12 psi | 2–12 psi | 2–12 psi | 2–12 psi |

In recipe 2, the reverse pressure distribution is applied to the six zones to compensate for a decreased polishing rate at the center 202*b* of wafer 202 as shown in FIG. 3C. Because a higher pressure is applied to zone 1, and progressively decreased up to zone 6, the polishing rate at the center of the wafer will be increased due to the increased back pressure at the center of the wafer 202. As such, with the increased pressure being applied at the back side of the center of the wafer 202, the polishing rate throughout the entire wafer will be substantially even, thereby correcting the non-uniformities.

In recipe N, a higher pressure is selectively programmed to be applied to zones 3 and 4, to compensate for slower polishing rates experienced in regions 202*c* shown in FIG. 3C. Recipe N therefore illustrates that the ability to program the various zones of the back side pressure in a wafer carrier used in chemical mechanical polishing (CMP) is a powerful improvement over conventional constant pressure systems.

Figure 4:
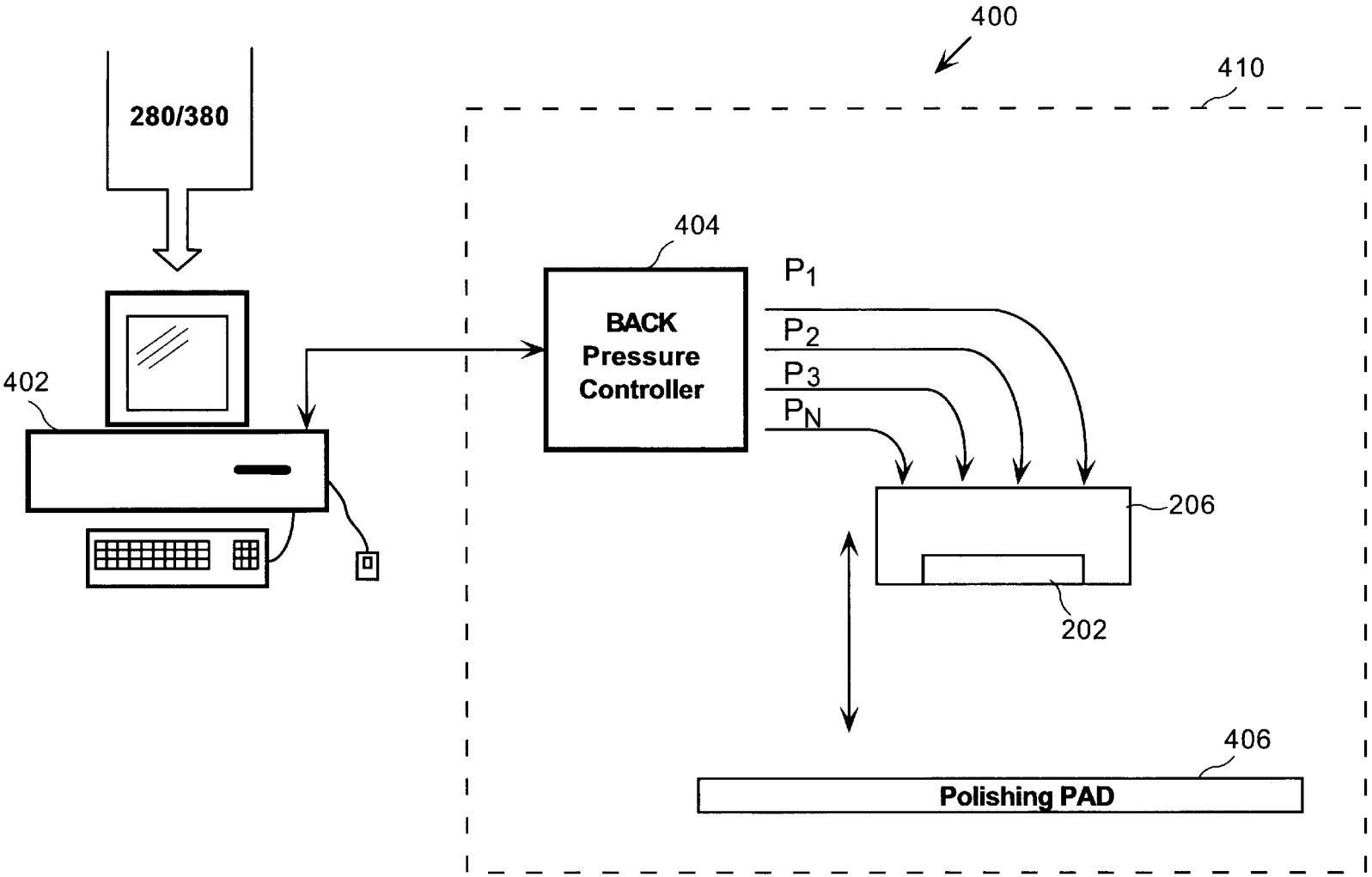
FIG. 4 is a simplified diagram of a computer system which is used to control the various pressures that are applied to the wafer carrier in accordance with one embodiment of the present invention.

FIG. 4 is a control station diagram 400 of a computer system 402 which is used to control the various pressures that are applied to the wafer carrier 206 in accordance with one embodiment of the present invention. The computer system 402 is preferably coupled to a back pressure controller, which includes well known control conduits and valves for controlling the amount of pressure delivered to each of the zones that distribute the pressure to the selected concentric rings in the wafer carrier 206. Therefore, the computer system 402 is preferably well suited to accept custom pressure tables (e.g., tables 280/380), for implementing a particular recipe in accordance with one embodiment of the present invention.

As is well known, the particular recipe is also dependent on the rotational speeds of the wafer carrier 206 and a polishing pad 406. In one embodiment, the back pressure controlled wafer carrier 206 may be implemented in any suitable chemical mechanical polishing (CMP) unit which is used to planarize layers that are applied to a semiconductor wafer during fabrication. By way of example, the layers may include dielectric layers, metallization layers, etc., that are required to be planarized before a next fabrication step is performed.

Therefore, an exemplary chemical mechanical polishing system 410 may be an IPEC Westech machine, Model No. AVANTI 472. Of course, it should be understood that the wafer carrier 206 and the back pressure controller 404 may be adapted to work in any chemical mechanical polishing system or other systems that would benefit from programmably controlling the back pressure of a substrate.

Figure 5:
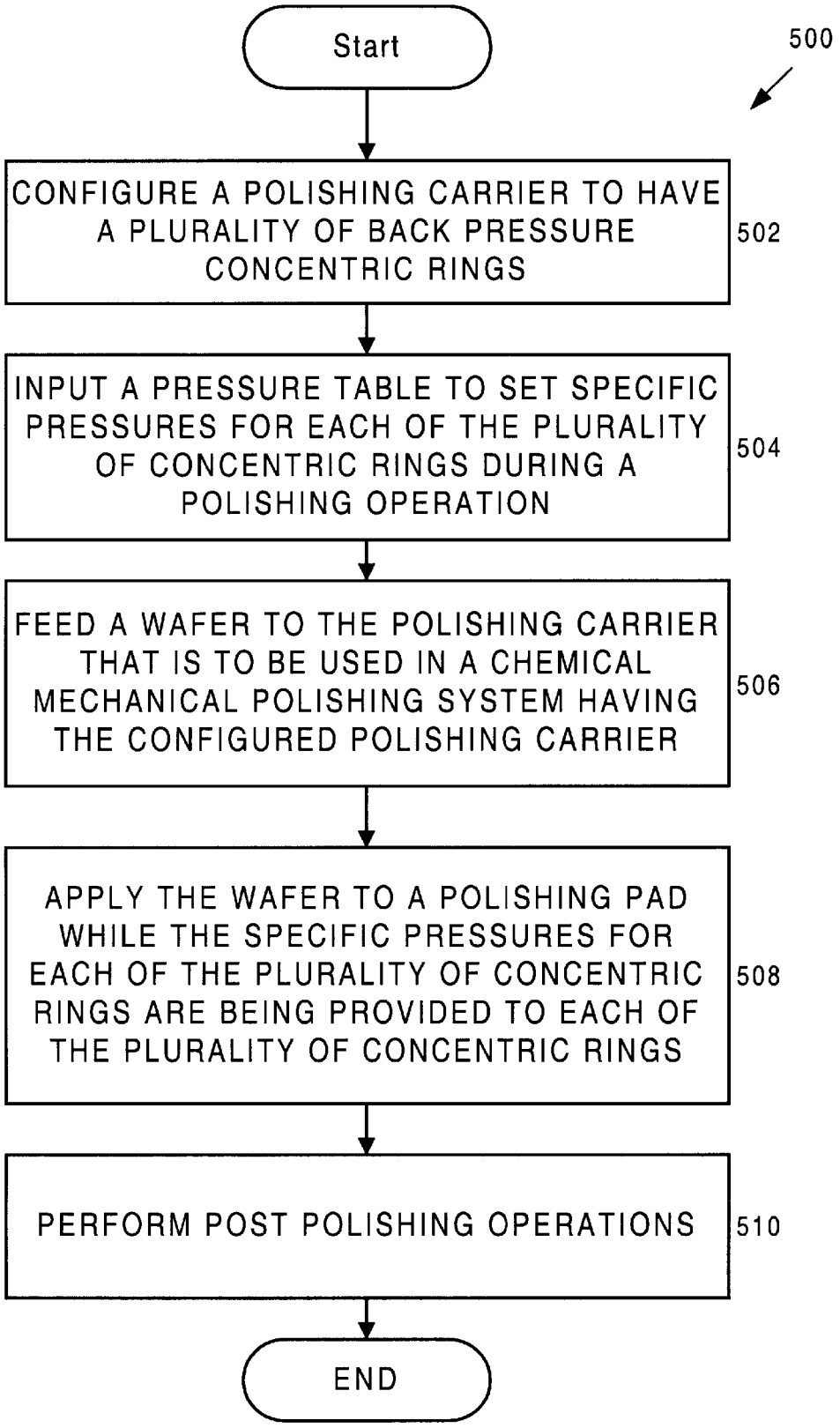
FIG. 5 is a flowchart diagram illustrating the preferred method operations for performing a controlled programmable polishing operation in accordance with one embodiment of the present invention.

FIG. 5 is a flowchart diagram illustrating the preferred method operations for performing a controlled programmable polishing operation in accordance with one embodiment of the present invention. The method begins at an operation 502 where a polishing carrier is configured to have a plurality of back pressure concentric rings. The back pressure concentric rings define zones for applying differing pressures to the back side of a particular substrate that is to be planarized during a fabrication process.

The method then proceeds to an operation 504 where a pressure table is input (i.e., typed-in or selected) to a computer system that is used to control a chemical mechanical polishing (CMP) system 410 in order to set specific pressures for each of the plurality of concentric rings during a polishing operation. By way of example, the pressure table may include pressure values for each of the number of zones which are desired for controlling back pressure during a CMP operation as shown in FIGS. 2D and 3B above. The method then proceeds to an operation 506 where a wafer is fed to the polishing carrier that is to be used in a chemical mechanical polishing system 410 having the configured polishing carrier.

By way of example, the polishing carrier is preferably also equipped with a method for implementing a vacuum for holding a wafer in the carrier when it is being moved from one location to another. Once the wafer is fed to the polishing carrier, the method will proceed to an operation 508. In operation 508, the wafer is applied to a polishing pad while the specific pressures for each of the plurality of concentric rings is being provided to each of the plurality of concentric rings. In this manner, the pressures identified in the table are applied to the desired locations for controllably setting the back pressure during a CMP operation.

Once the polishing operation is complete, the vacuum is again initiated to hold the wafer to the carrier before it is lifted away from the polishing pad and moved to another location to complete the post-polishing operations of operation 510. Once the post-polishing operations are completed, the method will end.

The invention may employ various computer-implemented operations involving data stored in computer systems to control the back pressure controller 404. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations described herein that form part of the invention are useful machine operations. The invention also relates to a device or an apparatus for performing these operations. The apparatus may be specially constructed for the required purposes, or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations. An exemplary structure for the invention is described below.

Figure 6:
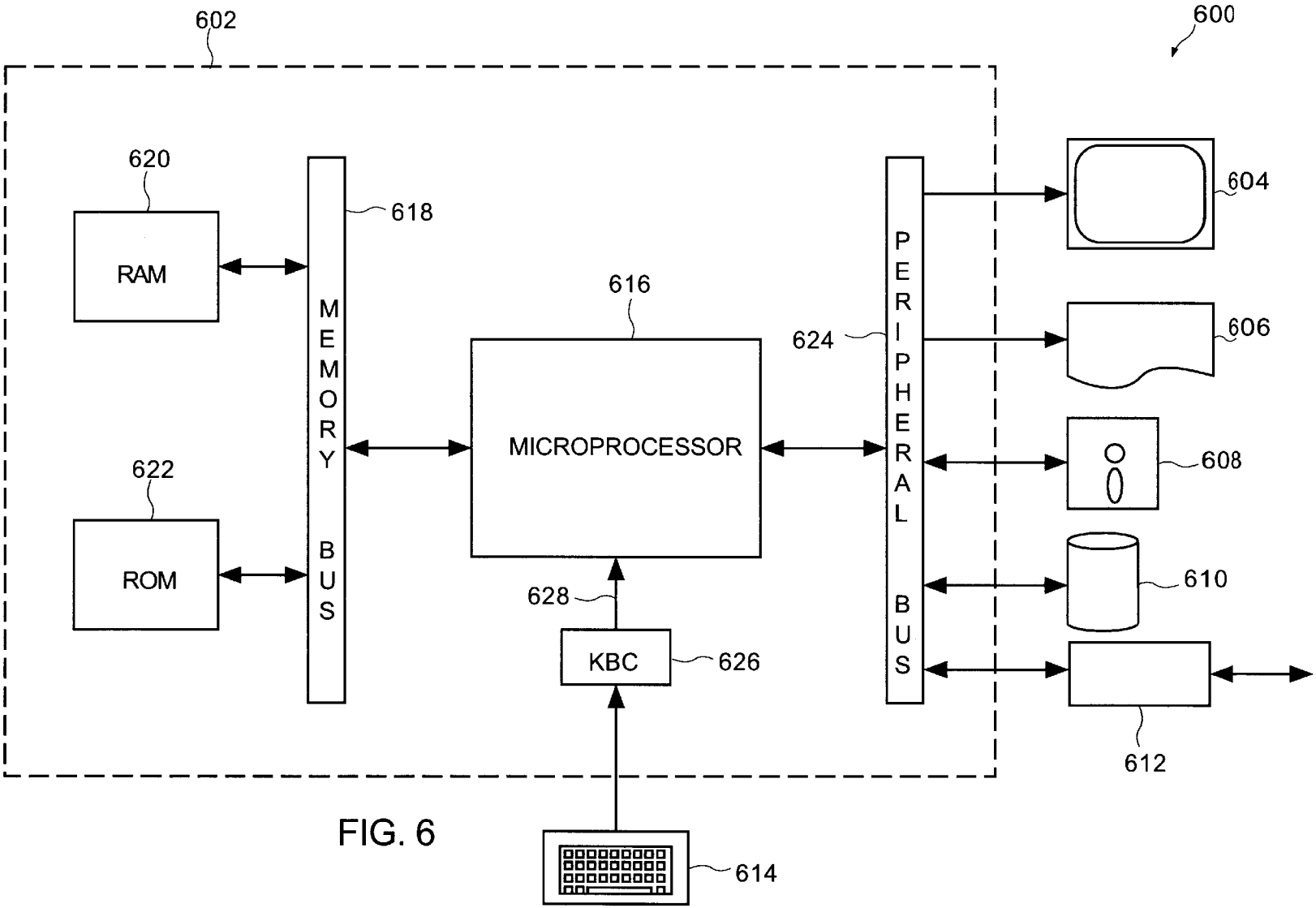
FIG. 6 is a block diagram of an exemplary computer system for carrying out the processing in accordance with one embodiment of the present invention.

FIG. 6 is a block diagram of an exemplary computer system 600 for carrying out the processing according to the invention. The computer system 600 includes a digital computer 602, a display screen (or monitor) 604, a printer 606, a floppy disk drive 608, a hard disk drive 610, a network interface 612, and a keyboard 614. The digital computer 602 includes a microprocessor 616, a memory bus 618, random access memory (RAM) 620, read only memory (ROM) 622, a peripheral bus 624, and a keyboard controller 626. The digital computer 600 can be a personal computer (such as an IBM compatible personal computer, a Macintosh computer or Macintosh compatible computer), a workstation computer (such as a Sun Microsystems or Hewlett-Packard workstation), or some other type of computer.

The microprocessor 616 is a general purpose digital processor which controls the operation of the computer system 600. The microprocessor 616 can be a single-chip processor or can be implemented with multiple components. Using instructions retrieved from memory, the microprocessor 616 controls the reception and manipulation of input data and the output and display of data on output devices. According to the invention, a particular function of microprocessor 616 is to assist in the control of chemical mechanical polishing (CMP) systems and pressure application controllers.

The memory bus 618 is used by the microprocessor 616 to access the RAM 620 and the ROM 622. The RAM 620 is used by the microprocessor 616 as a general storage area and as scratch-pad memory, and can also be used to store input data and processed data. The ROM 622 can be used to store instructions or program code followed by the microprocessor 616 as well as other data.

The peripheral bus 624 is used to access the input, output, and storage devices used by the digital computer 602. In the described embodiment, these devices include the display screen 604, the printer device 606, the floppy disk drive 608, the hard disk drive 610, and the network interface 612. The keyboard controller 626 is used to receive input from keyboard 614 and send decoded symbols for each pressed key to microprocessor 616 over bus 628.

The display screen 604 is an output device that displays images of data provided by the microprocessor 616 via the peripheral bus 624 or provided by other components in the computer system 600. The printer device 606 when operating as a printer provides an image on a sheet of paper or a similar surface. Other output devices such as a plotter, typesetter, etc. can be used in place of, or in addition to, the printer device 606.

The floppy disk drive 608 and the hard disk drive 610 can be used to store various types of data. The floppy disk drive 608 facilitates transporting such data to other computer systems, and hard disk drive 610 permits fast access to large amounts of stored data.

The microprocessor 616 together with an operating system operate to execute computer code and produce and use data. The computer code and data may reside on the RAM 620, the ROM 622, or the hard disk drive 610. The computer code and data could also reside on a removable program medium and loaded or installed onto the computer system 600 when needed. Removable program mediums include, for example, CD-ROM, PC-CARD, floppy disk and magnetic tape.

The network interface 612 is used to send and receive data over a network connected to other computer systems. An interface card or similar device and appropriate software implemented by the microprocessor 616 can be used to connect the computer system 600 to an existing network and transfer data according to standard protocols.

The keyboard 614 is used by a user to input commands and other instructions to the computer system 600. Other types of user input devices can also be used in conjunction with the present invention. For example, pointing devices such as a computer mouse, a track ball, a stylus, or a tablet can be used to manipulate a pointer on a screen of a general-purpose computer.

The invention can also be embodied as computer readable code on a computer readable medium. The computer readable medium is any data storage device that can store data which can be thereafter be read by a computer system. Examples of the computer readable medium include read-only memory, random-access memory, CD-ROMs, magnetic tape, optical data storage devices. The computer readable medium can also be distributed over a network coupled computer systems so that the computer readable code is stored and executed in a distributed fashion.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A wafer carrier for use in polishing a semiconductor wafer, comprising:

a carrier body having a recessed portion for retaining the semiconductor wafer, the recessed portion having a carrier film that is in direct contact with a back side of the semiconductor wafer; and a plurality of pressure cavity rings defined in the carrier body, such that the plurality of pressure cavity rings are in direct contact with the carrier film, each of the plurality of cavity pressure rings being configured to receive a selected pressure that is applied to the carrier film in the form of a selected back pressure, such that the carrier film is configured to exert the selected back pressure in zones defined by the plurality of pressure cavity rings against the back side of the semiconductor wafer.

2. A wafer carrier for use in polishing a semiconductor wafer as recited in claim 1, wherein when an increased pressure is set to be received by a selected one of the plurality of pressure cavity rings, an increased back pressure is produced against zones of the back side of the semiconductor wafer in a circular area of the semiconductor wafer that is associated with the selected one of the plurality of pressure cavity rings.

3. A wafer carrier for use in polishing a semiconductor wafer as recited in claim 1, wherein each of the plurality of pressure cavity rings is divided by a plurality of pressure separation ridges.

4. A wafer carrier for use in polishing a semiconductor wafer as recited in claim 3, wherein the carrier film has a plurality of pin holes that extend from the plurality of pressure cavity rings down to the back side of the semiconductor wafer.

5. A wafer carrier for use in polishing a semiconductor wafer as recited in claim 4, wherein the pin holes provide a vacuum passage that assists the recessed portion of the carrier body to retain the semiconductor wafer when the semiconductor wafer is not in contact with a polishing pad.

6. A wafer carrier for use in polishing a semiconductor wafer as recited in claim 4, further comprising a polishing system having a connector that is configured to receive the carrier body.

7. A wafer carrier for use in polishing a semiconductor wafer as recited in claim 6, wherein the polishing system is coupled to a back pressure controller that is coupled to a computer control station.

8. A wafer carrier for use in polishing a semiconductor wafer as recited in claim 7, wherein the computer control station is configured to perform a setting of the selected pressures to each of the plurality of pressure cavity rings of the carrier body.

9. A wafer carrier for use in polishing a semiconductor wafer as recited in claim 1, wherein the wafer carrier is used in a chemical mechanical polishing system.

10. A method for using a wafer carrier to be implemented in a semiconductor wafer polishing system, comprising the acts of:

providing a carrier body having a recessed end for receiving a wafer;

defining a plurality of circular cavities in a region of the carrier body that is behind the wafer, each of the plurality of circular cavities having an adjacent surface that lies behind the wafer when the wafer is in the recessed end of the carrier body; and providing a selected pressure to each of the plurality of circular cavities to cause a predetermined back pressure on the adjacent surface that lies behind the wafer.

11. A method for using a wafer carrier to be implemented in a semiconductor wafer polishing system as recited in claim 10, wherein the selected pressure that is provided to each of the plurality of circular cavities is set from a control station that is in communication with a back pressure controller.

12. A method for using a wafer carrier to be implemented in a semiconductor wafer polishing system as recited in claim 10, further comprising:

inputting a pressure table that identifies the selected pressure for each of the plurality of circular cavities.

13. A method for using a wafer carrier to be implemented in a semiconductor wafer polishing system as recited in claim 12, wherein when the selected pressure is increased, a polishing rate of the wafer increases in a circular area of the wafer that corresponds to a selected one of the plurality of circular cavities that receives the increased pressure.

14. A method for using a wafer carrier to be implemented in a semiconductor wafer polishing system as recited in claim 10, wherein the selected pressure is provided to each of the plurality of circular cavities when the carrier body is lowered to a polishing pad to place the wafer in contact with the polishing pad.

15. A method for using a wafer carrier to be implemented in a semiconductor wafer polishing system as recited in claim 14, wherein a vacuum pressure is applied to each of plurality of circular cavities when the carrier body is not in contact with the polishing pad.

16. A method for using a wafer carrier to be implemented in a semiconductor wafer polishing system as recited in claim 15, wherein the plurality of circular cavities is divided into one of a set of six circular cavities and a set of three circular cavities.

17. A method for using a wafer carrier to be implemented in a semiconductor wafer polishing system as recited in claim 16, wherein when a 6 inch wafer is being polished, a pressure of about 8 psi is applied to an outer one of the set of six circular cavities, and a pressure of about 6 psi is applied to an inner one of the set of six circular cavities.

18. A method for using a wafer carrier to be implemented in a semiconductor wafer polishing system as recited in claim 17, wherein the pressure of about 8 psi that is applied to the outer one of the six circular cavities causes the predetermined back pressure on the adjacent surface that lies behind the wafer to increased a polishing rate on a wafer surface that lies under the outer one of the six circular cavities.

19. A method for using a wafer carrier to be implemented in a semiconductor wafer polishing system as recited in claim 16, wherein when a 6 inch wafer is being polished, a pressure of about 8 psi is applied to an outer one of the set of three circular cavities, and a pressure of about 6 psi is applied to an inner one of the set of three circular cavities.

20. A method for using a wafer carrier to be implemented in a semiconductor wafer polishing system as recited in claim 19, wherein the pressure of about 8 psi that is applied to the outer one of the three circular cavities causes the predetermined back pressure on the adjacent surface that lies behind the wafer to increased a polishing rate on a wafer surface that lies under the outer one of the three circular cavities.

21. A method for using a wafer carrier to be implemented in a semiconductor wafer polishing system as recited in claim 11, wherein the control station that communicates to the back pressure controller is integrated with a chemical mechanical polishing system.

22. A chemical mechanical polishing system, comprising:

a mechanical arm;

a carrier body configured to be coupled to the mechanical arm, the carrier body having a recessed portion for retaining a semiconductor wafer, the recessed portion having a carrier film that is in direct contact with a back side of the semiconductor wafer; and a plurality of pressure cavity rings defined in the carrier body, such that the plurality of pressure cavity rings are in direct contact with the carrier film, each of the plurality of pressure cavity rings being used to apply a selected pressure to the carrier film, such that the carrier film produces a back pressure against the back side of the semiconductor wafer in a plurality of concentric zones defined by each of the plurality of pressure cavity rings;

whereby the selected pressure that is applied to each of the plurality of pressure cavity rings controls a polishing rate of the semiconductor wafer at the plurality of concentric zones.

23. A chemical mechanical polishing system as recited in claim 22, wherein inner ones of the plurality of pressure cavity rings are divided by a plurality of pressure separation ridges.

24. A chemical mechanical polishing system as recited in claim 23, wherein the carrier film has a plurality of pin holes that extend from the plurality of pressure cavity rings down to the back side of the semiconductor wafer.

25. A chemical mechanical polishing system as recited in claim 23, wherein the pin holes provide a vacuum passage that assists the recessed portion of the carrier body to retain the semiconductor wafer when the semiconductor wafer is not in contact with a polishing pad.

* * * * *